US005517769A

United States Patent [19]

Zhao

[11] Patent Number: 5,517,769

[45] Date of Patent: May 21, 1996

[54] SPRING-LOADED SNAP-TYPE SHOE

[76] Inventor: Yi Zhao, 219 S. Elmer Ave. Apt. 1, Sayre, Pa. 18840

[21] Appl. No.: 480,393

[22] Filed: Jun. 7, 1995

[51] Int. Cl.[6] ..... A43B 13/28; A43B 3/10

[52] U.S. Cl. ..... 36/27; 36/7.8

[58] Field of Search ..... 36/25 R, 27, 28, 36/37, 7.8, 38

[56] References Cited

U.S. PATENT DOCUMENTS

| | | | |
|---|---|---|---|
| 3,834,046 | 9/1974 | Fowler | 36/28 |
| 4,831,750 | 5/1989 | Müller | 36/28 |
| 5,138,776 | 8/1992 | Levin | 36/27 X |
| 5,187,883 | 2/1993 | Penney | 36/27 X |
| 5,437,110 | 8/1995 | Goldston et al. | 36/27 X |

FOREIGN PATENT DOCUMENTS

| | | | |
|---|---|---|---|
| 1302331 | 7/1962 | France | 36/28 |

*Primary Examiner*—Paul T. Sewell
*Assistant Examiner*—BethAnne C. Dayoan

[57] ABSTRACT

A spring-loaded snap-type shoe including a compressible flexible sole having a bottom wall, a top wall, and a peripheral side wall extended therebetween to define a hollow interior, the sole additionally having a toe section, a heel section, and an intermediate section extended therebetween including a bendable ball portion and an arch portion; an elastic back plate disposed within the interior of the sole, the back plate having a rear end coupled to the side wall of the sole at the heel section thereof, a front end with a hook formed thereon positioned at a location adjacent with the ball portion of the sole, and a curved intermediate part extended therebetween and positioned in contact with the top wall of the sole; and an elongated front plate disposed within the interior of the sole, the front plate having a front end coupled to the side wall of the sole at the toe section, a back end with a hook formed thereon positioned at a location above the hook of the back plate, and an intermediate part extended therebetween, and with the hooks snappedly fastenable and unfastenable while a wearer walks or runs.

5 Claims, 3 Drawing Sheets

SPRING-LOADED SNAP-TYPE SHOE

BACKGROUND OF THE INVENTION

1. Field of the Invention

The present invention relates to a spring-loaded snap-type shoe and more particularly pertains to transferring propulsive forces to a foot of a wearer when the wearer is walking or running with a spring-loaded snap-type shoe.

2. Description of the Prior Art

The use of spring-loaded shoes is known in the prior art. More specifically, spring-loaded shoes heretofore devised and utilized for the purpose of transferring forces to a foot of a wearer are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,391,048 to Lutz discloses an elastic sole for a shoe incorporating a spring member. U.S. Pat. No. 5,042,175 to Ronen et al. discloses a user-specific shoe sole coil spring system and method. U.S. Pat. No. 5,179,791 to Lain discloses a torsional spring insole and method. U.S. Pat. No. 5,228,217 to Dabuzhsky et al. discloses a method and a shoe sole construction for transferring stresses from ground to foot. U.S. Pat. No. 5,279,051 to Whatley discloses footwear cushioning springs. U.S. Pat. No. 5,283,963 to Lerner et al. discloses a sole for transferring stresses from ground to foot.

While these devices fulfill their respective, particular objective and requirements, the aforementioned patents do not describe a spring-loaded snap-type shoe that applies a propulsive force to a user's foot while walking or running, thereby reducing stress and muscle fatigue.

In this respect, the spring-loaded snap-type shoe according to the present invention substantially departs from the conventional concepts and designs of the prior art, and in doing so provides an apparatus primarily developed for the purpose of transferring propulsive forces to a foot of a wearer when the wearer is walking or running.

Therefore, it can be appreciated that there exists a continuing need for new and improved spring-loaded snap-type shoe which can be used for transferring propulsive forces to a foot of a wearer when the wearer is walking or running. In this regard, the present invention substantially fulfills this need.

SUMMARY OF THE INVENTION

In the view of the foregoing disadvantages inherent in the known types of spring-loaded shoes now present in the prior art, the present invention provides an improved spring-loaded snap-type shoe. As such, the general purpose of the present invention, which will be described subsequently in greater detail, is to provide a new and improved spring-loaded snap-type shoe and method which has all the advantages of the prior art and none of the disadvantages.

To attain this, the present invention essentially comprises, in combination, a downwardly compressible and flexible sole with a foot covering extended upwards therefrom. The foot covering is formed of a flexible toe panel, a flexible heel panel, and a pair of opposed flexible side panels. The panels of the covering define a foot holding space and an opening for receiving a wearer's foot. The sole further has a bottom wall with an upper surface and a lower surface, a top wall with an upper surface and a lower surface, and a peripheral side wall extended therebetween to define a hollow interior. The sole additionally has a toe section upon which toes of a wearer's foot rests, a heel section upon which a heel of a wearer's foot rests, and an intermediate section extended therebetween and with the intermediate section including a bendable ball portion upon which a ball of a wearer's foot rests and an arch portion upon which an arch of a wearer's foot rests.

An elongated and generally elastic back plate is included. The back plate is disposed within the interior of the sole to act in a spring-like capacity. The back plate has an upwardly curved rear end coupled to the side wall of the sole at the heel section thereof and with the rear end positioned adjacently to the upper surface of the bottom wall of the sole, a front end with an upwardly facing rigid hook formed thereon and with the hook positioned upon the upper surface of the bottom wall of the sole at a location adjacent with the ball portion of the sole, and a curved intermediate part extended between the hook and the rear end and positioned in facing contact with the lower surface of the top wall of the sole.

An elongated front plate is included and disposed within the interior of the sole. The front plate has a downwardly curved front end coupled to the side wall of the sole at the toe section thereof and positioned adjacently to the lower surface of the top wall of the sole, a back end with a downwardly facing rigid hook formed thereon and with the hook positioned adjacently with the ball portion of the sole and in contact with the lower surface of the top wall at a location above the hook of the back plate, and a straight intermediate part extended across the toe section of the sole between the base end and hook. The hooks are fastenable together in a snap-type relation when the back plate is pressed downwards and extended toward the toe section in a biased configuration through weight placed upon the sole by a wearer's foot during a downstep. The hooks are snappedly unfastenable when the sole is bent at the ball portion by a wearer's foot during an upstep and thereby allowing the back plate to return to an unbiased orientation and thus applying a propulsive upward force to the wearer's heel. The hooks repeatedly fasten on downsteps and release on upsteps when a wearer is walking or running.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spring-loaded snap-type shoe which has all the advantages of the prior art spring-loaded shoes and none of the disadvantages.

It is another object of the present invention to provide a new and improved spring-loaded snap-type shoe which may be easily and efficiently manufactured and marketed.

It is a further object of the present invention to provide a new and improved spring-loaded snap-type shoe which is of durable and reliable construction.

An even further object of the present invention is to provide a new and improved spring-loaded snap-type shoe which is susceptible of a low cost of manufacture with regard to both materials and labor, and which accordingly is then susceptible of low prices of sale to the consuming public, thereby making such a spring-loaded snap-type shoe economically available to the buying public.

Still yet another object of the present invention is to provide a new and improved spring-loaded snap-type shoe which provides in the apparatuses and methods of the prior art some of the advantages thereof, while simultaneously overcoming some of the disadvantages normally associated therewith.

Even still another object of the present invention is to provide a new and improved spring-loaded snap-type shoe for transferring propulsive forces to a foot of a wearer when the wearer is walking or running.

Lastly, it is an object of the present invention to provide a new and improved spring-loaded snap-type shoe comprising a compressible sole having a bottom wall, a top wall, and a peripheral side wall extended therebetween to define a hollow interior, the sole additionally having a toe section, a heel section, and an intermediate section extended therebetween including a bendable ball portion and an arch portion; an elastic back plate disposed within the interior of the sole, the back plate having a rear end coupled to the side wall of the sole at the heel section thereof, a front end with a hook formed thereon positioned at a location adjacent with the ball portion of the sole, and a curved intermediate part extended therebetween and positioned in contact with the top wall of the sole; and an elongated front plate disposed within the interior of the sole, the front plate having a front end coupled to the side wall of the sole at the toe section, a back end with a hook formed thereon positioned at a location above the hook of the back plate, and an intermediate part extended therebetween, the hooks snappedly fastenable together when the back plate is pressed downwards in a biased configuration through weight placed upon the sole by a wearer's foot during a downstep, the hooks snappedly unfastenable when the sole is bent at the ball portion by a wearer's foot during an upstep and thereby allowing the back plate to return to an unbiased orientation and thus applying a propulsive upward force to the wearer's heel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
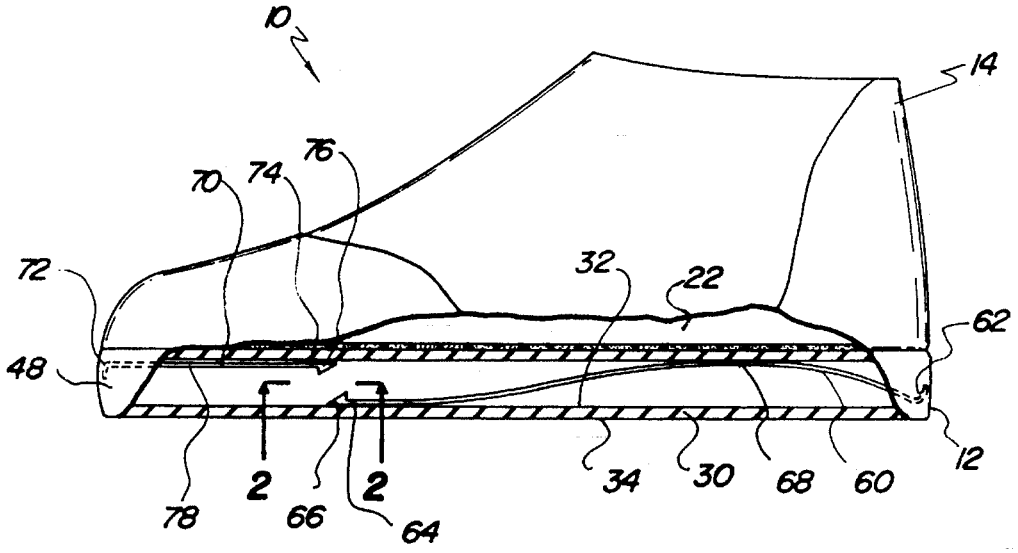
FIG. 1 is a side and fragmented cross-sectional view of the preferred embodiment constructed in accordance with the principals of the present invention. In this view, no weight is currently being placed on the sole.
Figure 2:
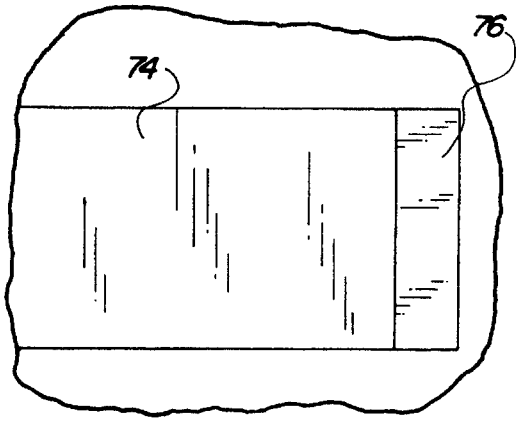
FIG. 2 is a view of the hooks of the present invention taken along the line 2—2 of FIG. 1.
Figure 3:
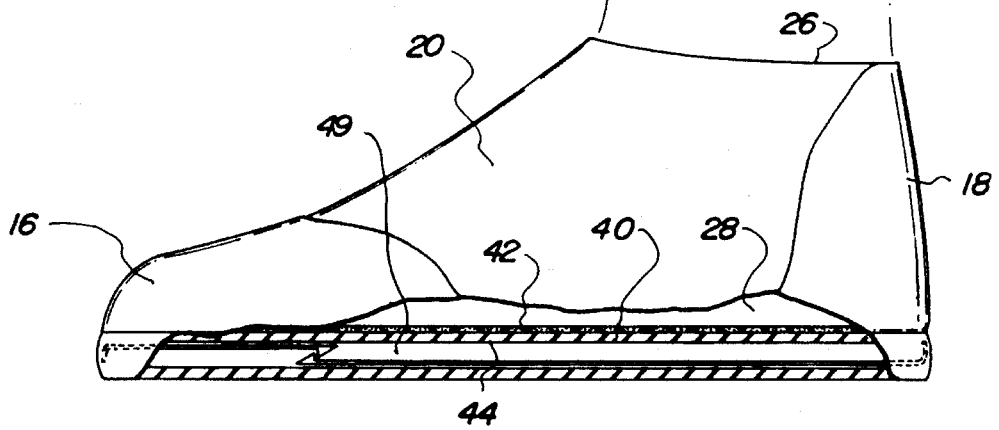
FIG. 3 is another side and fragmented cross-sectional view of the present invention when weight is placed on the sole.
Figure 4:
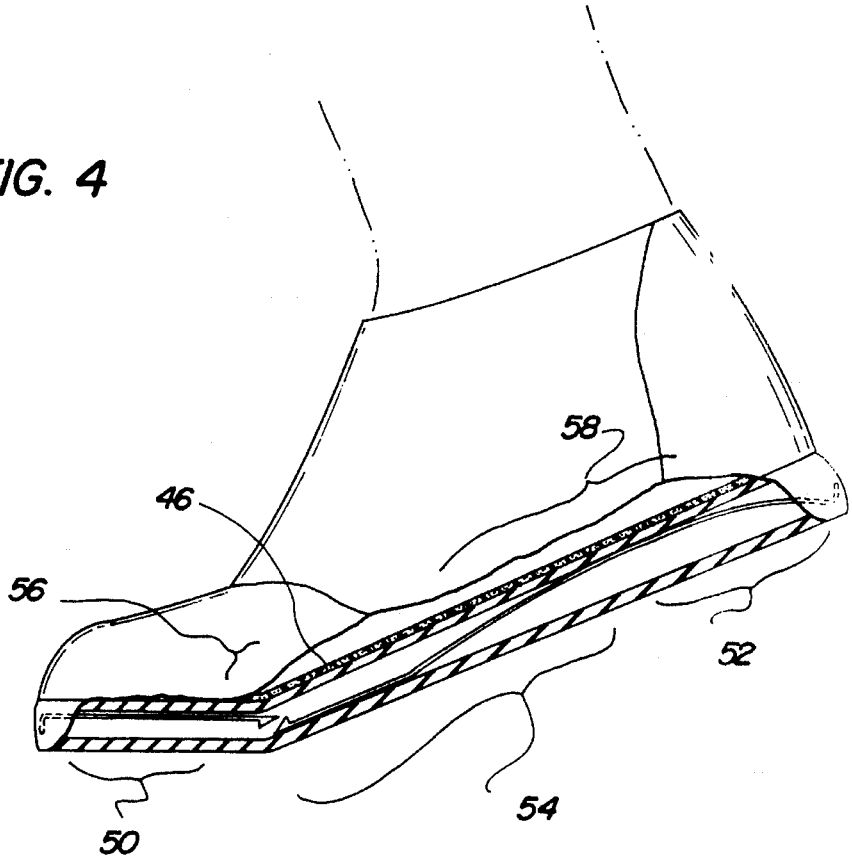
FIG. 4 is a side and fragmented cross-sectional view of the present invention with the hooks shown in a released orientation when a wearer lifts his heel upwards when walking or running.

With reference now to the drawings, and in particular, to FIG. 1 thereof, the preferred embodiment of the new and improved spring-loaded snap-type shoe embodying the principles and concepts of the present invention and generally designated by the reference number 10 will be described.

The preferred embodiment of the present invention comprises a plurality of components. In their broadest context, such components include a sole, foot covering, back plate, and front plate. Such components are individually configured and correlated with respect to each other to provide a structure that transfers propulsive forces to a foot of a wearer when the wearer is walking or running.

Specifically, the present invention includes a sole 12. The sole is formed of a flexible elastic material such as rubber and is downwardly compressible. A foot covering 14 is extended upwards from the sole. The foot covering is formed of a flexible toe panel 16, a flexible heel panel 18, and a pair of opposed flexible side panels 20. The panels can be formed of a cloth, plastic, fabric material, or the like. The panels define a foot holding space 22 and an opening 26 for receiving a wearer's foot 28 upon the sole 12.

The sole has a generally planar bottom wall 30 with an upper surface 32 and a lower surface 34. In addition, the sole includes a generally planar top wall 40 with an upper surface 42 and a lower surface 44. A layer of foam padding 46 is disposed upon the upper surface 32 of the bottom wall for cushioning a wearer's foot. A peripheral side wall 48 is extended upwards between the walls 30, 40 to define a hollow interior 49. The sole is additionally divided into a toe section 50 upon which toes of a wearer's foot rests, a heel section 52 upon which a heel of wearer's foot rests, and an intermediate section 54 extended therebetween. The intermediate section 54 includes a bendable ball portion 56 upon which a ball of a wearer's foot rests and an arch portion 58 upon which an arch of a wearer's foot rests.

An elongated and generally elastic back plate 60 is disposed within the interior of the sole. The back plate is formed of a metal which has sufficient tensile strength and spring constant to act in a spring-like capacity. The backplate is positioned in an unbiased orientation when at rest and a biased orientation when depressed downwards. The backplate has an upwardly curved rear end 62 coupled to side wall 48 of the sole at the heel section 52. The rear end is further positioned adjacently to the upper surface 32 of the bottom wall of the sole. The back plate 60 has a front end 64 with an upwardly facing rigid hook 66 formed thereon. The hook 66 is positioned upon the upper surface 32 of the bottom wall of the sole at a location adjacent with the ball portion 56. In addition, a curved intermediate part 68 is extended between the hook 66 and the rear end 62. The intermediate part 68 is positioned in facing contact with the lower surface 44 of the bottom wall of the sole.

An elongated front plate 70 is disposed within the interior of the sole. The front plate is formed of a generally rigid metal. The front plate has a downwardly curved front end 72 coupled to the side wall 48 of the sole at the toe section 50. The front end 72 is positioned adjacent to the lower surface 44 of the top wall of the sole 12. The front plate has a back end 74 with a downwardly facing rigid hook 76 formed thereon. The hook 76 is positioned adjacent with the ball portion 56 of sole and placed in contact with the lower surface 44 of the top wall. The hook 76 is also positioned at a location above the hook 64 of the back plate. In addition, a straight intermediate part 78 is extended across the toe section 50 of the sole between the front end 72 and hook 76. The hooks 64, 76 are fastenable together in a snap-type relation when the backplate 60 is pressed downwards and extended toward the toe section 50 in a biased configuration through weight placed upon the sole by a wearer's foot 28 during a downstep. The hooks 64, 76 are further snappedly unfastenable when the sole is bent at the ball portion 56 by a wearer's foot during an upstep, thereby allowing the backplate to return to an unbiased orientation. When the backplate is returned to the unbiased orientation, a propulsive spring-like upward force is applied to the wearer's heel thereby making it easier for a user to walk or run. The hooks repeatedly fasten on downsteps and release on upsteps when a wearer is walking or running. The spring-like action of the sole in combination with the fastening action of the hooks thereby provides a propelling force to relieve tension and stress on a wearer's leg muscles when the wearer is walking or running.

Figure 6:
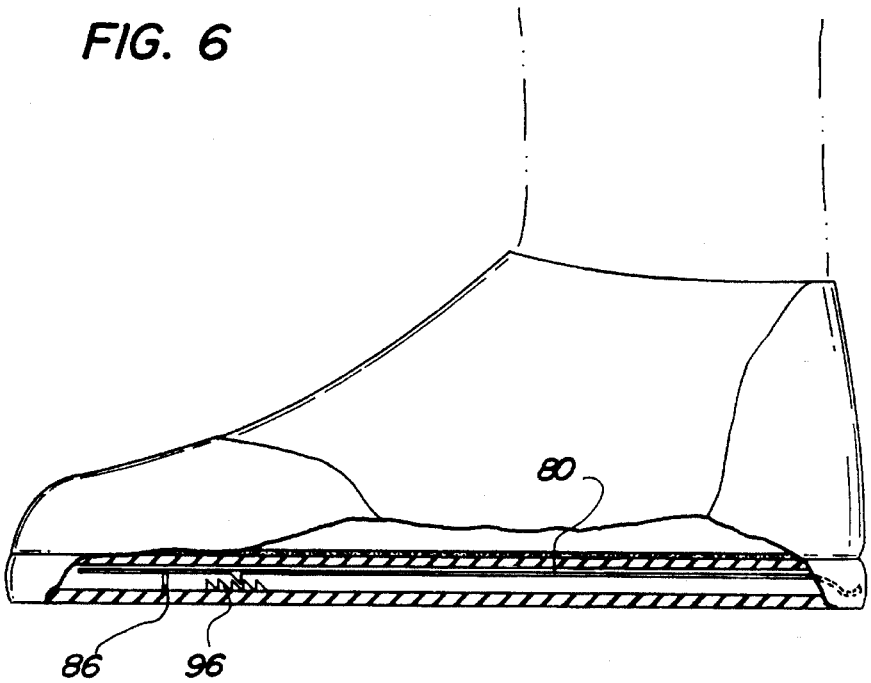
FIG. 6 is another view of the second embodiment of the present invention with weight placed upon the sole to allow the hooks to be fastened together.
Figure 5:
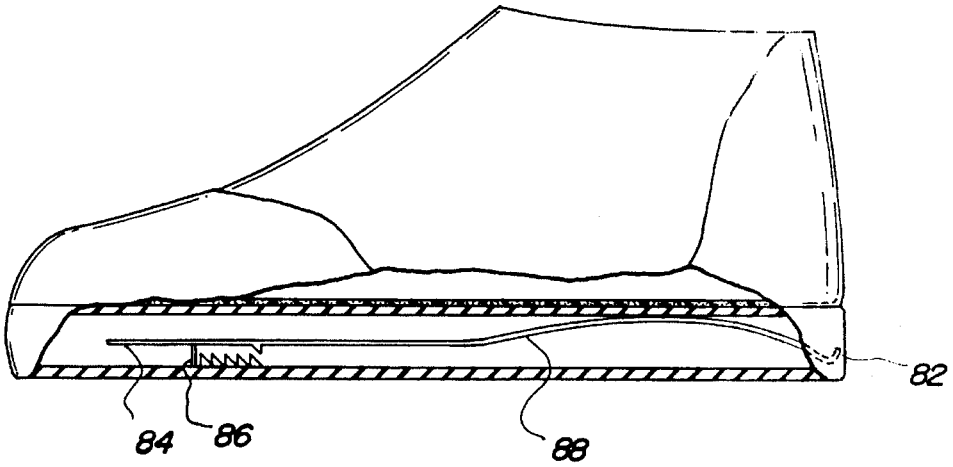
FIG. 5 is a side and fragmented cross-sectional view of another embodiment of the present invention. In this view, no weight is currently being placed on the sole.
Figure 7:
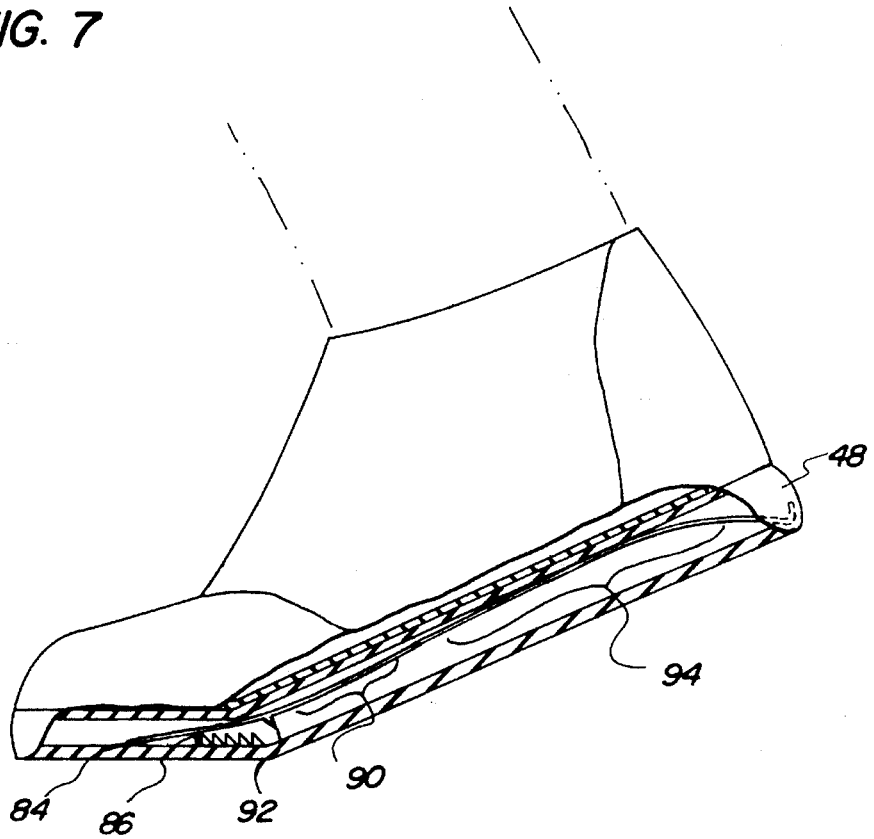
FIG. 7 is another side elevational and cross-sectional view of the second embodiment of the present invention with the hooks being released when a wearer lifts his heel upwards when walking or running.

A second embodiment of the present invention is shown in FIGS. 5 through 7. This embodiment includes a flexible sole 12 as previously described. In addition, an elongated and generally elastic back plate 80 is disposed within the interior of the sole to act in a spring-like capacity. The backplate has an upwardly curved rear end 82 coupled to the side wall 48 of the sole at the heel section. The rear end is positioned adjacent to the top surface of the bottom wall of the sole. The backplate 80 also includes a front end 84 with a plate support 86 projected perpendicularly downwards therefrom. An intermediate part 88 is extended between the front end and the rear end. The intermediate part has a forward extent 90 with a downwardly facing rigid hook 92 formed thereon at a location adjacent with the ball portion 50 of the sole. In addition, intermediate part includes a rearward extent 94 positioned in facing contact with the lower surface 44 of the top wall of the sole.

A sequential array of teeth 96 are coupled to the upper surface 32 of the bottom wall of the sole at a location between the hook 92 and the plate support 86. The teeth are formed of a rigid metal. The hook 92 and teeth 96 are fastenable together in a snap-type relation when the back plate 80 is pressed downwards and extended toward the toe section in a biased configuration through weight placed upon the sole by a wearer's foot during a downstep. The hook and teeth are further snappedly unfastenable when the sole is bent at the ball portion 50 by a wearer's foot during an upstep. The plate support 86 in combination with front end 84 acts as a fulcrum and thereby allows the backplate to return to an unbiased orientation. When the backplate returns to such unbiased orientation, a propulsive upward force is applied to the wearer's heel, thus facilitating walking and running as previously described.

The present invention is a shoe that is very comfortable for walking and running. The present invention saves strength and wear and tear on a wearer's muscles. As a wearer walks, the back plate is pressed flat by body weight, and the back plate thus stretches ahead to fasten with the hook of the front plate. When the back of the shoe is lifted up, the hooks are unfastened and the back plate recoils to return to its original shape, thereby applying power to the foot.

In an alternate embodiment to the present invention, the back plate includes a plate support extended downwardly toward teeth formed on the upper surface of the bottom wall of the sole. The plate support thus prevents excessive retraction of the back plate when a wearer lifts his heel on an upstep. The plate support also serves as a fulcrum for allowing the hook to be readily released from the plurality of hooks on an upstep.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A spring-loaded snap-type shoe for transferring propulsive forces to a foot of a wearer when the wearer is walking or running comprising, in combination:

a downwardly compressible and flexible sole with a foot covering extended upwards therefrom formed of a flexible toe panel, a flexible heel panel, and a pair of opposed flexible side panels and with the panels defining a foot holding space and an opening for receiving a wearer's foot, the sole further having a bottom wall with an upper surface and a lower surface, a top wall with an upper surface and a lower surface, and a peripheral side wall extended therebetween to define a hollow interior, the sole additionally having a toe section upon which toes of a wearer's foot rests, a heel section upon which a heel of a wearer's foot rests, and an intermediate section extended therebetween and with the intermediate section including a bendable ball portion upon which a ball of a wearer's foot rests and an arch portion upon which an arch of a wearer's foot rests;

an elongated and generally elastic back plate disposed within the interior of the sole to act in a spring-like capacity, the back plate having an upwardly curved rear end coupled to the side wall of the sole at the heel section thereof and with the rear end positioned adjacently to the upper surface of the bottom wall of the sole, a front end with an upwardly facing rigid hook formed thereon and with the hook positioned upon the upper surface of the bottom wall of the sole at a location adjacent with the ball portion of the sole, and a curved intermediate part extended between the hook and the rear end and positioned in facing contact with the lower surface of the top wall of the sole;

an elongated front plate disposed within the interior of the sole, the front plate having a downwardly curved front end coupled to the side wall of the sole at the toe section thereof and positioned adjacently to the lower surface of the top wall of the sole, a back end with a downwardly facing rigid hook formed thereon and with the hook positioned adjacently with the ball portion of the sole and in contact with the lower surface of the top wall at a location above the hook of the back plate, and a straight intermediate part extended across the toe section of the sole between the front end and hook, the hooks fastenable together in a snap-type relation when the back plate is pressed downwards and extended toward the toe section in a biased configuration through weight placed upon the sole by a wearer's foot during a downstep, the hooks snappedly unfastenable when the sole is bent at the ball portion by a wearer's foot during an upstep and thereby allowing the back plate to return to an unbiased orientation and thus applying a propulsive upward force to the wearer's heel, and with the hooks repeatedly fastening on downsteps and releasing on upsteps when a wearer is walking or running.

2. A spring-loaded snap-type sole comprising:

a compressible sole having a bottom wall, a top wall, and a peripheral side wall extended therebetween to define a hollow interior, the sole additionally having a toe section, a heel section, and an intermediate section extended therebetween including a bendable ball portion and an arch portion;

an elastic back plate disposed within the interior of the sole, the back plate having a rear end coupled to the side wall of the sole at the heel section thereof, a front end with a hook formed thereon positioned at a location adjacent with the ball portion of the sole, and a curved intermediate part extended therebetween and positioned in contact with the top wall of the sole; and an elongated front plate disposed within the interior of the sole, the front plate having a front end coupled to the side wall of the sole at the toe section, a back end with a hook formed thereon positioned at a location above the hook of the back plate, and an intermediate part extended therebetween, the hooks snappedly fastenable together when the back plate is pressed downwards in a biased configuration through weight placed upon the sole by a wearer's foot during a downstep, the hooks snappedly unfastenable when the sole is bent at the ball portion by a wearer's foot during an upstep and thereby allowing the back plate to return to an unbiased orientation and thus applying a propulsive upward force to the wearer's heel.

3. A spring-loaded snap-type sole for transferring propulsive forces to a foot of a wearer when the wearer is walking or running comprising, in combination:

a downwardly compressible and flexible sole having a bottom wall with an upper surface and a lower surface, a top wall with an upper surface and a lower surface, and a peripheral side wall extended therebetween to define a hollow interior, the sole additionally having a toe section upon which toes of a wearer's foot rests, a heel section upon which a heel of a wearer's foot rests, and an intermediate section extended therebetween and with the intermediate section including a bendable ball portion upon which a ball of a wearer's foot rests and an arch portion upon which an arch of a wearer's foot rests;

an elongated and generally elastic back plate disposed within the interior of the sole to act in a spring-like capacity, the back plate having an upwardly curved rear end coupled to the side wall of the sole at the heel section thereof and with the rear end positioned adjacently to the upper surface of the bottom wall of the sole, a front end with a plate support projected downwardly therefrom, and an intermediate part extended between the front end and the rear end and with the intermediate part having a forward extent with a downwardly facing rigid hook formed thereon at a location adjacent with the ball portion of the sole and a curved rearward extent positioned in facing contact with the lower surface of the top wall of the sole;

a sequential array of teeth coupled to the upper surface of the bottom wall of the sole at a location between the hook and the plate support, the hook and teeth fastenable together in a snap-type relation when the back plate is pressed downwards and extended toward the toe section in a biased configuration through weight placed upon the sole by a wearer's foot during a downstep, the hook and teeth snappedly unfastenable when the sole is bent at the ball portion by a wearer's foot during an upstep with the plate support acting as a fulcrum and thereby allowing the back plate to return to an unbiased orientation and thus applying a propulsive upward force to the wearer's heel, and with the hook and teeth repeatedly fastening on downsteps and releasing on upsteps when a wearer is walking or running.

4. The spring-loaded snap-type sole as set forth in claim 2 and further comprising a foot covering extended upwards from the sole formed of a flexible toe panel, a flexible heel panel, and a pair of opposed flexible side panels and with the panels defining a foot holding space and an opening for receiving a wearer's foot.

5. The spring-loaded snap-type sole as set forth in claim 2 wherein the sole is formed of an elastomeric material and wherein the plates are formed of metal.

* * * * *